United States Patent [19]

Papajewski

[11] 3,954,070

[45] May 4, 1976

[54] ADJUSTABLE LOOP TAKER SUPPORT FOR SEWING MACHINES

[75] Inventor: Reinhold Papajewski, Buchig, Germany

[73] Assignee: The Singer Company, New York, N.Y.

[22] Filed: May 28, 1975

[21] Appl. No.: 581,599

[52] U.S. Cl. ..... 112/182

[51] Int. Cl.[2] ..... D05B 57/14

[58] Field of Search ..... 112/181, 182, 183, 189, 112/190, 192, 184, 191, 193

[56] References Cited

UNITED STATES PATENTS

| | | | |
|---|---|---|---|
| 3,420,200 | 1/1969 | Johnson | 112/182 X |
| 3,492,959 | 2/1970 | Wenz et al. | 112/182 X |
| 3,602,167 | 8/1971 | Papajewski | 112/184 X |

*Primary Examiner*—H. Hampton Hunter
*Attorney, Agent, or Firm*—Robert E. Smith; Marshall J. Breen; Edward L. Bell

[57] ABSTRACT

A sewing machine loop taker support bracket that is adjustable to permit the use of various size loop takers. The loop taker shaft is journalled in one end of the support bracket and is coupled by a timing belt to a lateral stud shaft journalled in the opposite end of the bracket, the stud shaft being driven through bevel gears by the machine bed shaft. Various size loop takers are accommodated by loosening the support bracket from the machine frame and adjusting the bracket about the stud shaft axis until the loop taker is properly positioned.

5 Claims, 3 Drawing Figures

14
16
18
17
20
12
28
22
23
25
21
23
24
3
26
23
27
23
10
33
32
36
34
52
30
61
54
55
43
44
42
45
47
3

ADJUSTABLE LOOP TAKER SUPPORT FOR SEWING MACHINES

BACKGROUND OF THE INVENTION

This invention relates to sewing machine loop taker saddles or supports and particularly to a support which is readily adjustable to permit the use of various size loop takers.

In the manufacture of sewing machine equipment, it is conventional to design the machine to accept only one standard size loop taker. In high-speed commercial type machines, it is often advantageous to provide some means whereby the machine can accept either a small diameter loop taker for very high-speed sewing, or the larger diameter loop takers where it is desired to make a long uninterrupted seam using a single underthread.

SUMMARY OF THE INVENTION

A sewing machine incorporating the present invention may readily be adjusted to accept various size loop takers. Briefly described, the present invention is for a loop taker support bracket which supports, at one end, a horizontally mounted loop taker shaft which is coupled by a timing belt to a stud shaft journalled in the opposite end of the bracket. The stud shaft is coupled by bevel gears to the machine bed shaft so that rotation of the bed shaft will rotate the loop taker shaft. The support bracket is clamped to the machine bed but may be loosened and adjusted upward or downward around the stud shaft axis so that loop takers of various diameters may be accurately positioned to accept the loops thrown by the reciprocating needle of the machine.

BRIEF DESCRIPTION OF THE DRAWINGS

In the drawings which illustrate a preferred embodiment of the invention.

DESCRIPTION OF THE PREFERRED EMBODIMENT

Figure 1:
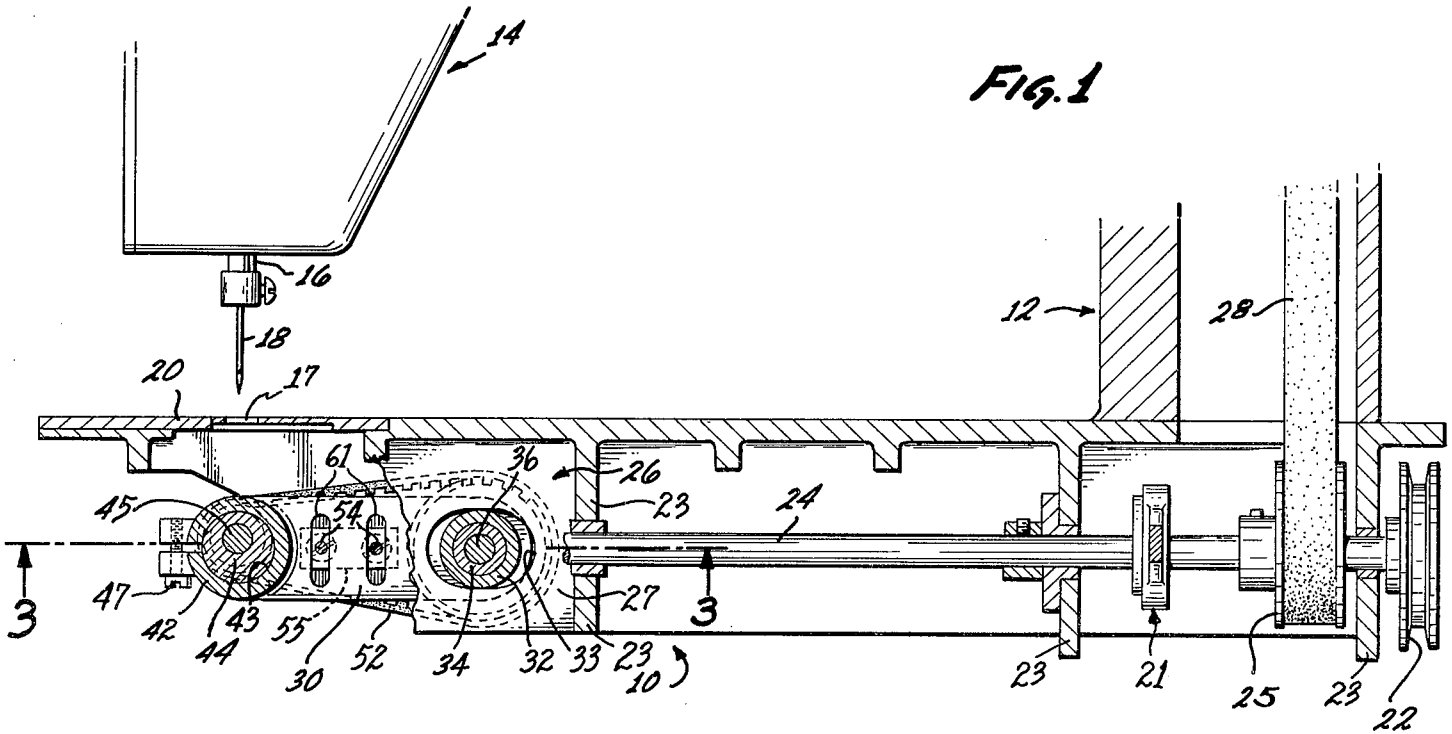
FIG. 1 is a front elevational view illustrating portions of a sewing machine incorporating the present invention with parts of the bed being illustrated in cross section taken substantially along line 1—1 of FIG. 2.

Turning now to a detailed description of the invention, FIG. 1 illustrates a partly cross sectional elevational view of a more or less typical zigzag sewing machine with a bed 10 having at one end a standard 12 which supports a bracket arm 14 that rises from and overhangs the bed 10. The bracket arm 14 supports a needle bar 16 to which is clamped a needle 18 which, during operation of the sewing machine, reciprocates through a laterally elongated needle aperture 19 in the throat plate 20 to provide a thread loop which is seized and manipulated by a loop taker 19 to form a stitch. Typically, the machine is powered through a pulley 22 connected to one end of the bed shaft 24 which is journalled through various vertical webs 23 formed transversely across the casting of the bed 10 to provide the necesssary power for rotation of the loop taker and actuation of other mechanisms in the bed such as a work feeding mechanism, portions of which are indicated at 21. Coupled to the bed shaft 24 and beneath the standard 12 is a sprocket 25 to which a timing belt 28 is connected to provide the necessary power to a bracket arm 14 for reciprocating the needle bar 16 and actuating other mechanism such as a thread takeup mechanism (not shown) within the bracket arm.

As previously mentioned, it is the usual practice in sewing machine construction to secure the loop taker to a shaft which is journalled in one predetermined position in the bed of the machine. It is apparent, therefore, that such a conventional machine cannot accommodate various size loop takers and must use a loop taker for which the machine was designed. In the embodiment described herein, the loop taker shaft is mounted to a support bracket which is movable so that the machine may accommodate various size loop takers.

Figure 2:
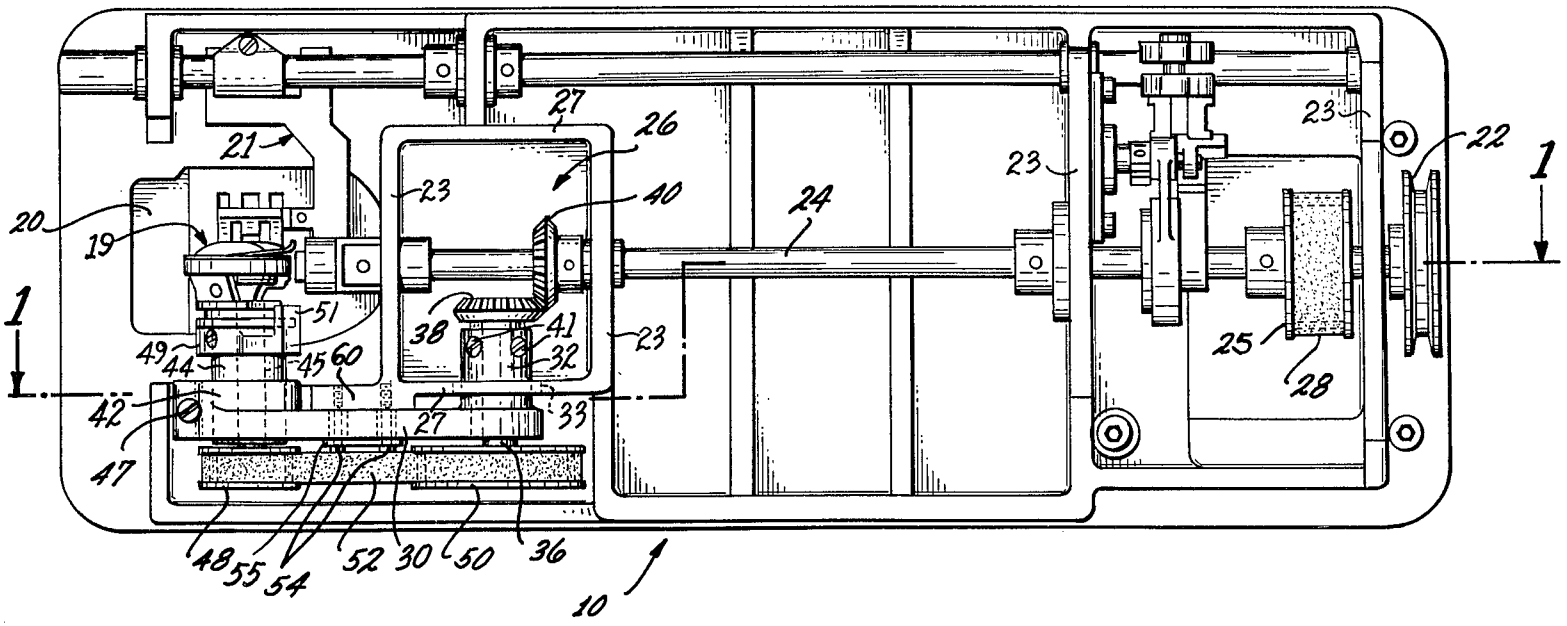
FIG. 2 is a bottom plan view of the sewing machine bed of FIG. 1.

As shown in FIGS. 1 and 2, and in greater detail in FIG. 3, the bed shaft 24 extends through a gear compartment 26 which is formed by adjacent vertical transverse webs 23 cast in the machine bed below the bed plate and is closed front and rear by webs 27 extending lengthwise of the bed. A support bracket 30 is positioned generally parallel to bed shaft 24 and is provided at one end with a laterally projecting cylindrical hub 32 which extends through an aperture 33 in the front web 27 defining the gear chamber 26. An axial hole 35 is bored through the hub 32 and is fitted with a journal bearing 34 which carries a rotatable stud shaft 36. Fixed to the end of stud shaft 36 that is within the gear compartment 26, is a bevel gear 38 which meshes with a corresponding bevel gear 40 secured to bed shaft 24. Secured to the opposite end of stud shaft 36 is a sprocket wheel 50. By means of set screws 41 threaded in the hub 32, the bearing 34 may be secured in selected axial position in the hub bore 35.

The aperture 33 in the gear compartment 26 is elongated lengthwise of the bed so that while the cylindrical hub 32 has a snug fit at top and bottom for pivotal movement therein, the hub can also slide a small amount within the elongated aperture to provide the necessary meshing adjustment between bevel gears 38 and 40.

The opposite end of support bracket 30 is formed with a split hub 42 having a circular opening 43 adapted to accommodate a bushing 44, the longitudinal axis of which is substantially parallel to the axis of stud shaft 36. As best illustrated in FIG. 3, a loop taker shaft 45 is journalled in a bore 46 which is formed eccentrically in the bushing 44. The bushing 44 may be secured in selected angular position by any suitable clamping means, such as a clamp screw 47 which tightens the split hub 42. A collar 49 may be secured on the bushing 44 and an outwardly extending finger grip 51 may be provided on the collar to facilitate angular adjustment of the bushing.

Figure 3:
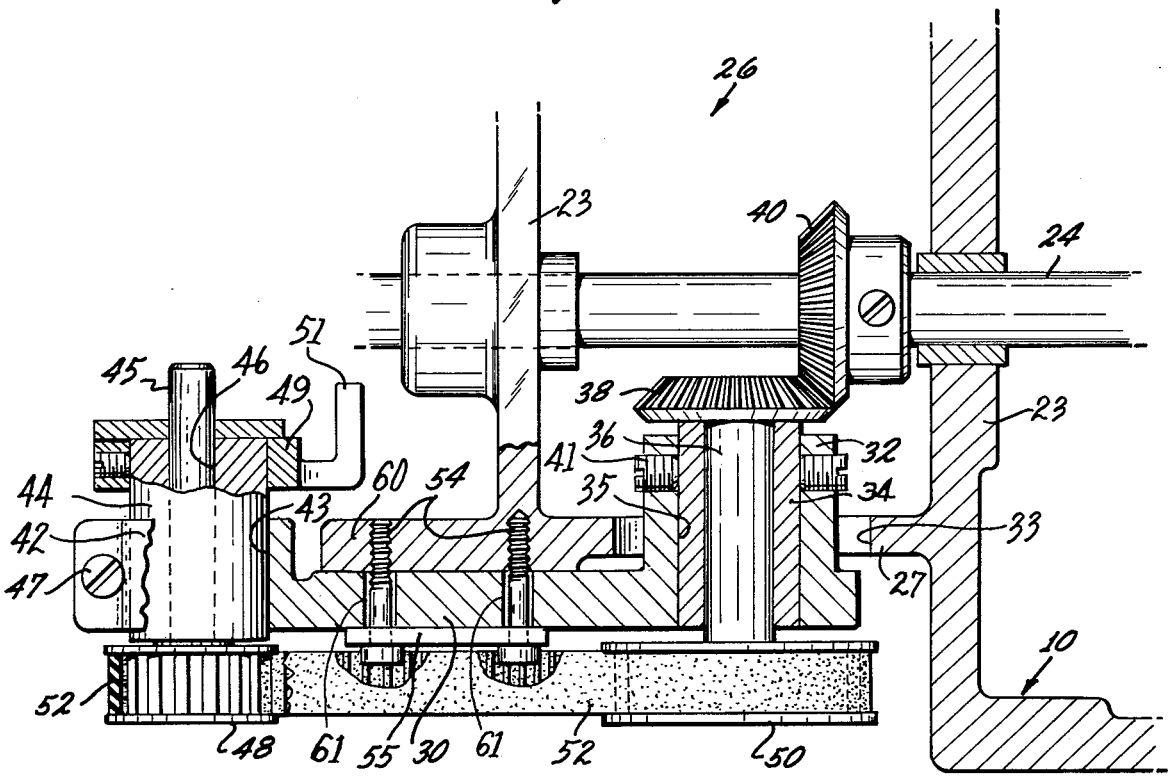
FIG. 3 is an enlarged bottom plan view illustrating in detail the loop taker support bracket incorporated in this invention shown partly in cross-section taken substantially along line 3—3 of FIG. 1.

As shown in FIG. 3, the loop taker shaft 45 extends beyond the support bracket 30 and carries a sprocket wheel 48. Preferably the sprocket wheel 48 is one-half the diameter of the sprocket wheel 50 and the two sprocket wheels are connected by a timing belt 52 to provide the usual 2:1 speed ratio between the loop taker and the bed shaft 24. Tension adjustments to the timing belt 52 are readily made by angular adjustment of the bushing 44 which will shift the eccentrically located loop taker shaft accommodating bore 46 toward and away from the axis of the stud shaft 36.

The support bracket 30 is clamped to a vertical web 60 in the bed 10 by two machine screws 54 which pass through a pair of oversize and vertically elongated holes 61 in the central web portion of the support bracket 30. In order for the bracket 30 to be adjustable upward or downward to accept various size loop takers; the elongated holes 61, as shown in FIG. 1, must be aligned and arrayed each substantially perpendicular to the longitudinal axis of the bracket 30. Thus, when it is desired to adjust the position of the loop taker shaft to accommodate a loop taker of different diameter, the screws 54 are loosened, support bracket 30 is moved about the axis of the stud shaft 36 to the desired position, and the screws 54 are re-tightened. A common washer element 55 may be provided for both of the screws 54.

Having set forth the nature of this invention, what is claimed herein is:

1. In a sewing machine having a bed and a bracket arm overhanging said bed, a reciprocating thread carrying needle arranged in said bracket arm, and a circularly moving loop taker arranged in said bed for cooperation with said needle in the formation of stitches, a mechanism for supporting and driving circularly moving loop takers of various diameters, said mechanism comprising: a support bracket having an elongated body with a circular hub at the first extremity and a second hub at the opposite extremity of said support bracket, means in said bed for sustaining said support bracket with capacity for angular adjustment thereof about the axis of the circular hub at the first extremity, a drive shaft journalled coaxially in said first hub, actuating mechanism carried in said sewing machine having operative connections for reciprocating said needle and operative driving connections to said drive shaft, a loop taker accommodating shaft journalled in said second hub of said support bracket, said loop taker accommodating shaft being substantially parallel to said drive shaft, means drivingly connecting said loop taker accommodatng shaft and said drive shaft on said support bracket, and means for clamping said support bracket to said bed in selected angular position of adjustment about the axis of the circular hub at the first extremity thereof so as to accommodate circularly moving loop takers of various diameters on said loop taker accommodating shaft.

2. In a sewing machine having a bed, a rotatable bed shaft longitudinally positioned within said bed, a reciprocating threaded needle operating in timed relationship with said bed shaft, and a loop taker positioned to engage thread loop thrown by said needle, a mechanism for supporting and driving loop takers of various diameters, said mechanism comprising: a support bracket having an elongated body with a first hub at the first end and a second hub at the second end of said bracket, said bracket being adjustably attached to the bed of the sewing machine and substantially parallel to the bed shaft; a stud shaft journalled in said first hub and substantially perpendicular to said bed shaft; one end of said stud shaft carrying a gear adapted for driving engagement with a corresponding gear mounted on said bed shaft; the other end of said stud shaft carrying a sprocket wheel; a loop taker shaft journalled in said second hub of said support bracket, said loop taker shaft being substantially parallel to said stud shaft and carrying, at one end, a sprocket wheel that is substantially aligned with the sprocket wheel on the end of said stud shaft, the opposite end of said loop taker shaft being adapted to receive a loop taker; and a timing belt coupling the sprocket wheel on said stud shaft with the sprocket wheel on said loop taker shaft.

3. The mechanism claimed in claim 1 wherein said loop taker shaft is journalled in said second hub in an eccentric bushing rotatably adjustable in said second hub.

4. The mechanism claimed in claim 1 wherein the first hub of said support body includes a boss supporting, longitudinally therethrough, said journalled stud shaft, said boss being adjustably positioned within an elongated slot in a web of said bed.

5. The mechanism claimed in claim 3 wherein said support bracket is adjustably attached to said bed of the sewing machine by screw fasteners extending through elongated slots in said support bracket, said slots being elongated in a direction substantially perpendicular to the longitudinal axis of said support bracket.

* * * * *